United States Patent [19]

Byrd

[11] 4,364,255

[45] Dec. 21, 1982

[54] CONTROLLED ORIENTED DISCHARGE OF CUPS FROM A BLANKING AND FORMING PRESS

[75] Inventor: James I. Byrd, Sidney, Ohio

[73] Assignee: The Stolle Corporation, Sidney, Ohio

[21] Appl. No.: 198,298

[22] Filed: Oct. 20, 1980

[51] Int. Cl.[3] ..... B21D 45/00

[52] U.S. Cl. ..... 72/345; 72/349; 72/405; 72/427; 413/45

[58] Field of Search ..... 72/346, 344, 345, 349, 72/405, 419, 427; 113/115; 406/88; 413/52, 45

[56] References Cited

U.S. PATENT DOCUMENTS 3,210,124 10/1965 Niemi et al. ..... 406/88

3,941,070 3/1976 Kaminski ..... 72/349

*Primary Examiner*—Leon Gilden

*Attorney, Agent, or Firm*—Frost & Jacobs

[57] ABSTRACT

Apparatus and method for discharging flanged cups in a controlled oriented fashion from a blanking and forming press. The formed cup is raised to a position slightly higher than the upper face of the drawing die, and moved in a straight line by means of a high pressure air pulse to the inlet of a conduit-like discharge chute. The formed cups are moved through the discharge chute by air pressure issuing from angled slots in the walls of the chute. The invention is particularly advantageous for use with blanking and forming presses simultaneously producing a plurality of formed cups in order to discharge the formed cups separately from each station in an orientation substantially the same as that in which the cup was formed. The invention eliminates damage to the formed cup caused by random bulk handling in conventional discharge equipment.

5 Claims, 3 Drawing Figures

CONTROLLED ORIENTED DISCHARGE OF CUPS FROM A BLANKING AND FORMING PRESS

SUMMARY OF THE INVENTION

The present invention is directed generally to a press for blanking and forming cups, and more particularly to an improved method and means for discharging the formed cups in a controlled oriented fashion.

In a conventional blanking and drawing press for making cups and the like, an upper blanking punch cooperates with a lower blanking punch to form a circular blank from a sheet or strip of product stock material. A number of blanks may be formed simultaneously from the same sheet. After the blanks have been cut, the blanking punches are held in place and drawing punches continue to descend into a cooperating die to draw the cup.

In presses of this sort for fabricating cups without flanges, the cups are stripped from the punch at the bottom of the stroke, usually onto a moving discharge conveyor belt or the like. However, many cups, particularly those designed primarily for use in food packaging, are drawn from pre-coated metal stock for subsequent processing into complete cans. It has been found that these cups must be drawn with a flange remaining on the upper edge or lip of the cup so as not to damage the coating which could render the cup unfit for use. In conventional practice, flanged cups of this type are stripped from the punch on an upstroke. The cups may then be forced out of the press by compressed air and randomly collected in a large funnel-type receptacle. From the receptacle, the formed cups are oriented so that all of the cups are aligned in the same direction for further processing. This conventional method for discharging the formed cups from the press not only requires additional orienting equipment, but may produce dents and scratches on the cups or jamming of the orienting equipment by the random bulk handling of the cups.

In the present invention, the discharge of the cups from the press is controlled in such a manner that the formed cups are automatically oriented in the same direction. The invention is particularly adaptable for use with blanking and drawing presses of the type having a plurality of simultaneously operating blanking and forming stations of the type described above in connection with a conventional press for producing from a strip of product stock a formed cup having a flange around the upper edge.

In a preferred embodiment, a lift-out member movable within the drawing die lifts the bottom of the formed cup to a point slightly higher than the upper face of the drawing die to locate the formed cup in a discharge position. A separator plate closely overlies the product stock strip and includes an opening associated with each blanking and forming station permitting free passage therethrough of the upper blanking punch.

A pair of spaced air exhaust nozzles is positioned adjacent each of the openings. A source of pressurized air provides a pressurized air pulse from the air exhaust nozzles to move the formed cups in a straight line from each of the stations onto the separator plate. Each of the openings in the separator plate is positioned and configured to permit free movement without stumbling of the cup onto the plate.

A conduit-like chute is positioned on the opposite side of each opening from the air exhaust nozzles, and includes a lower surface formed by the separator plate, spaced parallel vertical side walls extending away from the opening, and an upper surface spaced from and overlying the separator plate. The chute is dimensioned to permit free passage of the formed cups therethrough. Furthermore, the forward edges of the side walls adjacent the opening are beveled to facilitate entrance of the formed cup into the chute under the influence of the pressurized air blasts from the air nozzles. The side walls of the chute comprise hollow manifolds forming conveyor means for moving the formed cups through the chute, and include a plurality of slots in the inner surface of the walls spaced along the axis of the chute and angled at acute angles away from the opening. A flow of high volume low pressure air is supplied through these slots to provide a directional airflow to assist the formed cups in moving through the chute. Consequently, the discharge means of the present invention permits the formed cups from each of the blanking and forming stations to be separately conveyed in a controlled oriented fashion through the associated chute for further processing.

Further features of the invention will become apparent from the detailed description which follows.

DETAILED DESCRIPTION

Figure 1:
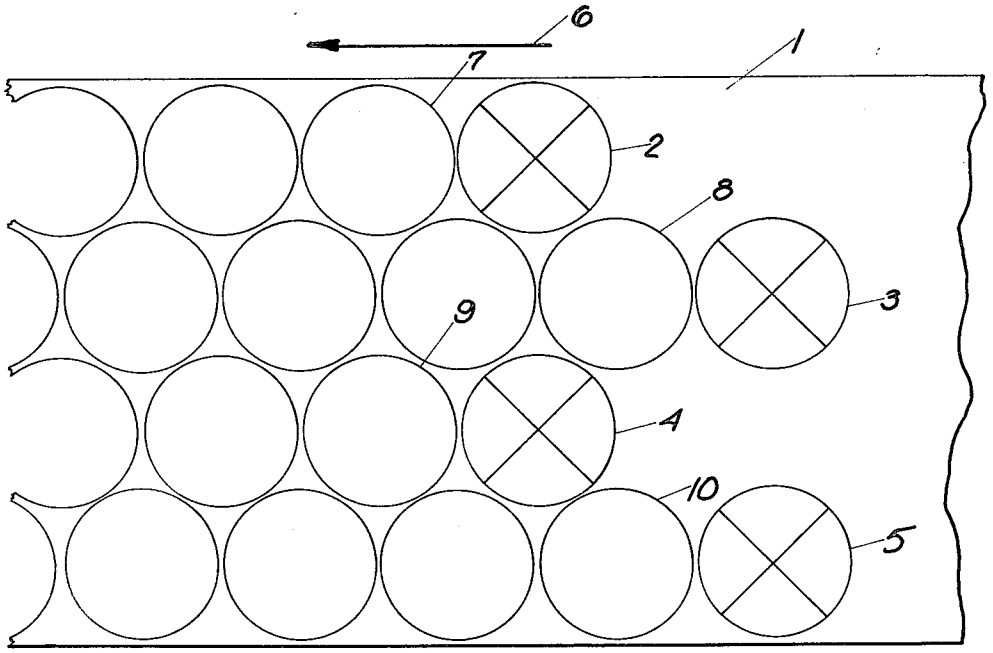
FIG. 1 is a fragmentary diagrammatic view of a representative product stock blanking pattern for use with the present invention.

As shown in FIG. 1, a conventional blanking and forming press is designed to simultaneously fashion a plurality of blanks from a sheet or strip of product stock, illustrated generally at 1. For purposes of an exemplary showing, the present invention will be described and illustrated in connection with a blanking and forming press which simultaneously forms four blanks, designated 2–5 in FIG. 1, in a staggered pattern. However, it will be understood that any number of blanks may be formed depending on the arrangement of the blanking and forming stations.

It will be further understood that after each blanking and forming operation, product stock strip 1 may be indexed in the direction of directional arrow 6 to simultaneously form a new set of blanks 7–10, and so forth.

Figure 3:
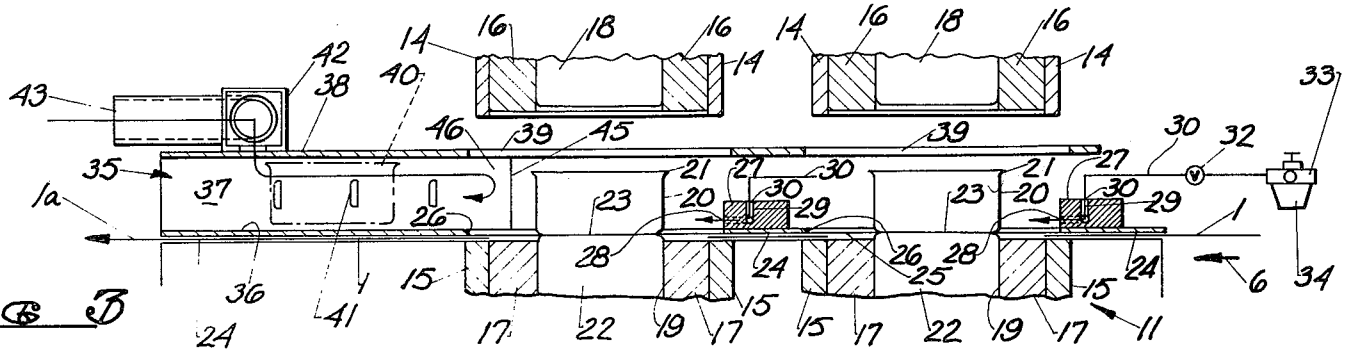
FIG. 3 is a fragmentary cross sectional view taken along section line 3—3 of FIG. 2 with cover 38 in place.
Figure 2:
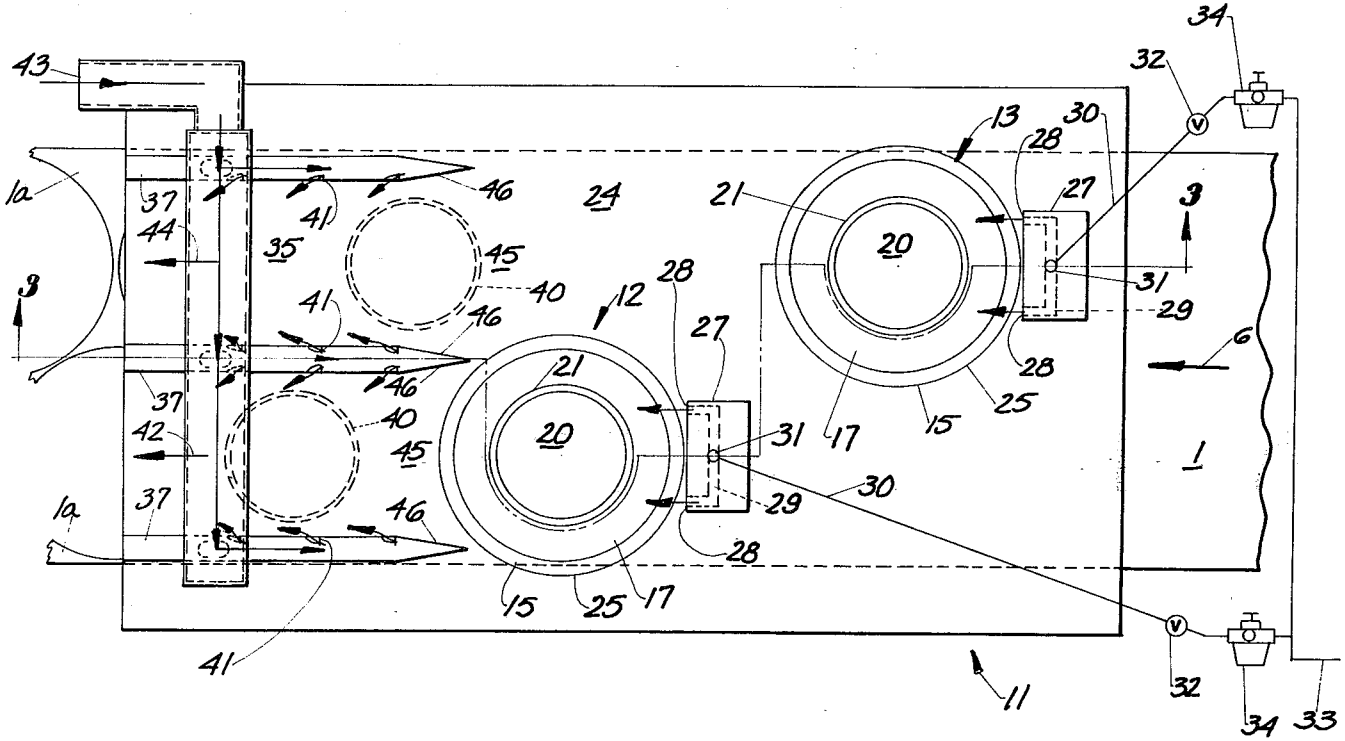
FIG. 2 is a fragmentary, partially diagrammatic, top plan view of the controlled oriented discharge mechanism of the present invention in combination with a conventional blanking and forming press with upper cover 38 removed.

The discharge mechanism of the present invention is illustrated in combination with a conventional blanking and forming press, generally at 11, in FIG. 2 and FIG. 3. In the embodiment illustrated, only two blanking and forming stations 12 and 13 are illustrated. However, it will be understood that the apparatus will include two additional forming stations for fashioning the blanking pattern illustrated in FIG. 1. It will be further understood that the description which follows in connection with the first blanking station 12 is equally applicable to the construction and operation of the second blanking station 13.

As best shown in FIG. 3, blanking station 12 includes a generally annular upper blanking punch 14 which cooperates with coaxially aligned generally annular lower combination blanking punch and pressure pad 17 for cutting a circular blank 2 from product stock strip 1 as is well known in the art. As illustrated in FIG. 3, the upper tooling has completed its stroke, and retracted from the lower blanking punch or collapsible stopper 15. However, it will be understood that in normal operation upper blanking punch 14 and lower blanking punch 17 will be in abutting engagement immediately after blank 2 is produced.

After the blank has been cut, blanking punches 14 and 17 maintain their position and the blanks are captured, under pressure to prevent wrinkling, between the lower surface of generally annular upper pressure pad 16 and the upper surface of generally annular lower pressure pad 17.

Generally annular drawing punch 18 then continues to descend into the die member 19 formed by the central opening of annular lower pressure pad 17 to draw the formed cup 20, leaving a flange 21 around the upper edge of cup 20 since the entire blank is not pressed into the drawing die member 19.

As drawing punch 18 retracts, generally annular lift-out member 22 moves upwardly to lift the bottom portion 23 of formed cup 20 to a position slightly higher than the upper face of drawing die member 19. For purposes of an exemplary showing, a spacing of approximately 0.05 inches will be maintained between the bottom 23 of the formed cup and the upper surface of the drawing die member 19.

A plate-like separator strip 24 closely overlies strip 1 in spaced parallel relationship thereto. Plate 24 is raised above the lower tooling surfaces a distance of approximately 2–3 times the thickness of strip 1. This space permits the skeleton scrap, shown at 1*a* near the left edge of FIG. 3, to pass underneath plate 24. Separator plate 24 includes a circular opening 25 associated with each blanking and forming station which permits free passage therethrough of upper blanking punch 14, upper pressure pads 16 and drawing punch 18. In general, the circumferential edge portion 26 of opening 25 will be configured to permit formed cup 21 to move easily onto the upper surface of plate 25 without stumbling or obstruction. For example, in a preferred embodiment, the edge portion 26 of opening 25 may be slightly angled as illustrated in FIG. 3.

A mounting block 27 containing a pair of spaced air exhaust nozzles 28 is positioned adjacent each of separator strip openings 25 such that nozzles 28 are directed toward the side of formed cup 20. Nozzles 28 are connected together by an air channel 29 within mounting block 28 which may be connected to a high pressure air supply line 30 as at 31.

A pressurized air pulse may be provided from air exhaust nozzles 28 by means of a remotely actuated valve 32 from a source of high pressure air 33 through regulator 34. It will be observed that the pressurized air pulses from the air exhaust nozzles are such as to move the formed cups 20 in a straight line to the left as viewed in FIG. 3 onto the upper surface of separator plate 24.

A conduit-like chute, shown generally at 35, is positioned on the side of separator plate opening 25 opposite air exhaust nozzles 28. Chute 35 includes a lower surface 36 formed by the upper surface of separator plate 24, and a pair of spaced parallel vertical side walls 37 extending away from separator plate opening 25. It will be observed in FIG. 2 that chute 35 serving second blanking and forming station 13 shares a common side wall 37 with chute 35 serving blanking and forming station 12. It will be understood that additional chutes similar in construction to chute 35 may be added to complete the blanking and forming press for the particular blanking pattern desired.

The upper surface of chute 35 is completed by a plate-like cover 38 spaced from and overlying separator plate 24. Cover 38 includes a number of circular openings 39 generally coextensive with openings 25 to permit the free passage therethrough of upper blanking punch 14, upper pressure pad 16 and drawing punch 18. In addition, chute 35 is dimensioned to permit free passage of formed cup 20 therethrough as illustrated diagrammatically at 40.

Each of side walls 37 comprises a hollow manifold forming conveyor means for moving the formed cup 40 through chute 35. A plurality of slots, one of which is illustrated at 41, are provided through the inner surface of side walls 37 at spaced locations along the axis of the chute, and are angled at acute angles away from separator plate 25.

A hollow duct-like conduit 42 connects the upper edges of side walls 37 to supply a flow of high volume low pressure air from an appropriate air source 43. The flow of high volume low pressure air issuing from slots 41 provides an airflow in the direction of directional arrow 44 to assist the formed cups 40 in moving through chute 35. In addition, a slight vacuum is created at the entrance 45 of chute 35 which assists the formed cups in entering the chute. In addition, the forwardmost edges of side walls 37 may be beveled as at 46 to provide a larger opening to assist entry of the formed cups into the chute.

In operation, the cups 20 are formed from the strip of product stock material 1, and are lifted by means of lift-out members such that the bottom of the cup is substantially co-planar with the upper surface of separator plate 24. At this point, a pulse of high pressure air is emitted from air pressure nozzles 28 by opening remotely controlled valve 32 which moves formed cup 20 to the left as illustrated in FIG. 3 and onto the upper surface of separator plate 24. In general, the high pressure air pulse will be sufficient to move the formed cup into chute 35 where it may be moved through the chute under the influence of the high volume low pressure air issuing from slots 41. It will be observed that this process may operate continuously to insure that the individual cups fabricated at each blanking and forming station are individually discharged in a controlled oriented fashion into individual discharge chutes. Consequently, the random bulk handling which has proved unsatisfactory in prior art designs is completely eliminated.

It will be understood that various changes in the details, materials, steps and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. In a press for blanking and drawing flanged cups of the type having cooperating upper and lower blanking punches for cutting a circular blank from a strip of product stock material, upper and lower pressure pads for capturing the blank to prevent wrinkling, a drawing punch cooperating with a drawing die for forming from the blank a cup having a flange around the upper edge, and a lift-out member movable within said drawing die for lifting the bottom of the formed cup to a position slightly higher than the upper surface in the drawing die to locate the formed cup in a discharge position, the improvement in combination therewith comprising a separator plate closely overlying the material strip and having an opening permitting free passage therethrough of said upper blanking punch, said opening being positioned and configured to permit free movement without stumbling of the formed cup onto the plate, means for discharging the blanked and drawn cup from the die area of the press including chute means positioned adjacent said discharge position for accepting and guiding the formed cups in a controlled oriented fashion comprising a conduit-like chute positioned adjacent said discharge position and including a lower surface, spaced parallel vertical sidewalls extending away from said discharge position, and an upper surface spaced from an overlying said plate, said chute being dimensioned to permit free passage of the formed cup therethrough, and conveyor means for moving the formed cups through the chute, said conveyor means including hollow manifolds forming said sidewalls, a plurality of slots in the inner surface of said sidewall spaced along the axis of the chute and angled at acute angles away from said discharge position, and means for supplying a flow of high volume low pressure air to said sidewalls to provide directional air flow from said slots to assist the formed cups in moving through said chute, and means for moving the formed cups from said discharge position into said chute comprising an air exhaust nozzle positioned adjacent said discharge position and means for providing a pressurized air pulse from said air exhaust nozzle to move the formed cups into said chute.

2. The apparatus according to claim 1 including a pair of spaced air exhaust nozzles configured and positioned to move the formed cups in a straight line.

3. The apparatus according to claim 1 wherein the circumferential edge of the opening is angled.

4. The apparatus according to claim 1 wherein the forwardmost edges of said side walls adjacent said discharge position are beveled to facilitate entrance of the formed cups into the chute.

5. In a press for blanking and drawing flanged cups of the type having a plurality of simultaneously operating blanking and forming stations, each station including cooperating upper and lower blanking punches for cutting a circular blank from a strip of product stock material, upper and lower pressure pads for capturing the blank to prevent wrinkling, a drawing punch cooperating with a drawing die for forming from the blank a cup having a flange around the upper edge, a lift-out member movable within said drawing die for lifting the bottom of the formed cup to a position slightly higher than the upper face of the drawing die to locate the cup at a discharge position, the improvement in combination therewith comprising means for discharging the blanked and drawn metal cups from the press including:

a separator plate closely overlying the strip and having an opening associated with each blanking and forming station to permit free passage therethrough of said upper blanking punch;

a pair of spaced air exhaust nozzles positioned adjacent each of said openings;

means for providing a pressurized air pulse from said air exhaust nozzles to move the formed cups in a straight line from each of said stations onto said separator plate, each opening being positioned and configured to permit free movement without stumbling of the cup onto the plate;

a conduit-like chute positioned on the opposite side of each opening from said air exhaust nozzles including a lower surface formed by said plate, spaced parallel vertical side walls extending away from said opening, and an upper surface spaced from and overlying said plate, said chute being dimensioned to permit free passage of the formed cups therethrough, the edges of said side walls adjacent said opening being beveled to facilitate entrance of the formed cups into the chutes, said side walls comprising hollow manifolds forming conveyor means for moving the formed cup through said chutes including a plurality of slots in the inner surface of said walls spaced along the axis of the chute and angled at acute angles away from said plate opening; and means for supplying a flow of high volume low pressure air to said side walls to provide directional airflow from said slots to assist the formed cups in moving through said chutes, whereby the formed cups from each of said blanking and forming stations may be separately conveyed through the associated chute.

* * * * *